US012758855B2

(12) United States Patent
Xu

(10) Patent No.: US 12,758,855 B2
(45) Date of Patent: Oct. 13, 2026

(54) EASY-WEARING SKATE

(71) Applicant: Radical Sportech LLC, Taipei City (TW)

(72) Inventor: Guangwei Xu, Dongguan City (CN)

(73) Assignee: Radical Sportech LLC, Taipei City (TW)

( * ) Notice: Subject to any disclaimer, the term of this patent is extended or adjusted under 35 U.S.C. 154(b) by 310 days.

(21) Appl. No.: 18/609,325

(22) Filed: Mar. 19, 2024

(65) Prior Publication Data

US 2024/0342582 A1 Oct. 17, 2024

(30) Foreign Application Priority Data

Apr. 13, 2023 (CN) ..... 202320823516.0

(51) Int. Cl.
*A63C 17/00* (2006.01)

(52) U.S. Cl.
CPC .. *A63C 17/0086* (2013.01); *A63C 2017/0053* (2013.01)

(58) Field of Classification Search
CPC ..... A63C 17/0086; A63C 17/06; A63C 2017/0053
See application file for complete search history.

(56) References Cited

U.S. PATENT DOCUMENTS 5,171,033 A * 12/1992 Olson ..... A43B 5/1675 36/3 R
5,380,020 A * 1/1995 Arney ..... A63C 17/068 36/115
5,439,238 A * 8/1995 Neal ..... A63C 17/1436 280/11.221
5,480,168 A * 1/1996 Chen ..... A43B 5/16 280/11.223
5,487,552 A * 1/1996 Daoust ..... A63C 17/1436 280/11.214
5,575,489 A * 11/1996 Oyen ..... A63C 17/223 280/11.225
5,609,346 A * 3/1997 Bellehumeur ..... A63C 17/1427 188/29
5,634,648 A * 6/1997 Tonel ..... A63C 17/062 280/11.232
5,732,957 A * 3/1998 Yu ..... A63C 17/004 280/11.19
5,895,072 A * 4/1999 Coroneos ..... A63C 17/26 280/809

(Continued)

FOREIGN PATENT DOCUMENTS

CN 213077443 U 4/2021

*Primary Examiner* — Erez Gurari
(74) *Attorney, Agent, or Firm* — Muncy, Geissler, Olds & Lowe, P.C.

(57) ABSTRACT

An easy-wearing skate is provided, wherein the easy-wearing skate includes a boot having a chamber open upward, the boot further includes a fixed shell having a rear opening, and a movable shell rotatably connected to the fixed shell and configured to cover the rear opening, the movable shell is swingable away from the rear opening, a first tightening strap is connected to a side of the fixed shell, a locking device is connected to another side of the fixed shell, the first tightening strap is releasably locked by the locking device, and as the first tightening strap is released from the locking device, the movable shell can swing away relative to the fixed shell.

14 Claims, 5 Drawing Sheets

(56) References Cited

U.S. PATENT DOCUMENTS

| | | | | | |
|---|---|---|---|---|---|
| 5,904,359 | A * | 5/1999 | Caeran | A63C 17/062 | 280/11.208 |
| 6,015,157 | A * | 1/2000 | Hilgarth | A63C 17/067 | 280/11.27 |
| 6,068,268 | A * | 5/2000 | Cornelius | A63C 17/06 | 280/11.19 |
| 6,098,997 | A * | 8/2000 | Cheng | A63C 17/064 | 280/11.19 |
| 6,283,481 | B1 * | 9/2001 | Roman | A63C 17/1409 | 280/11.217 |
| 6,536,784 | B2 * | 3/2003 | Gorza | A63C 17/1409 | 280/11.214 |
| 2003/0067125 | A1 * | 4/2003 | Park | A43B 5/1633 | 280/11.221 |
| 2003/0098554 | A1 * | 5/2003 | Chen | A63C 17/06 | 280/11.221 |
| 2004/0261298 | A1 * | 12/2004 | Howard | A43B 5/1691 | 36/117.6 |
| 2005/0230927 | A1 * | 10/2005 | Lai | A63C 17/065 | 280/11.225 |
| 2006/0113735 | A1 * | 6/2006 | Hyser | A63C 17/06 | 280/11.221 |
| 2007/0132201 | A1 * | 6/2007 | Bellehumeur | A63C 17/1427 | 280/87.041 |
| 2012/0313336 | A1 * | 12/2012 | Chen | A63C 17/08 | 280/11.24 |
| 2015/0321074 | A1 * | 11/2015 | Barbera | A63C 1/22 | 280/11.3 |
| 2024/0342582 | A1 * | 10/2024 | Xu | A43B 5/1691 | |

* cited by examiner

EASY-WEARING SKATE

BACKGROUND OF THE INVENTION

Field of the Invention

The present invention relates to an easy-wearing skate.

Description of the Prior Art

Skate is a very popular recreational product. One type of the skate is the roller skate. Rollers are mounted to the sole of the roller skate such that it allows carrying out rolling and gliding at high speeds and make various movements.

CN213077443U discloses a skate which includes a boot having a chamber, a tongue member is provided in the chamber. There are adjustment lines disposed on both sides of the chamber and extending along the edges of the boot. The boot further includes an adjustment portion and a connection portion, the adjustment portion includes first eyelets, and the connection portion includes second eyelets. Since it needs to use a shoelace to tighten the boot during use, it is very inconvenient.

The present invention is, therefore, arisen to obviate or at least mitigate the above-mentioned disadvantages.

SUMMARY OF THE INVENTION

The main object of the present invention is to provide an easy-wearing skate which is easy and quick to put on or take off.

To achieve the above and other objects, an easy-wearing skate is provided, wherein the easy-wearing skate includes a boot having a chamber open upward, the boot further includes a fixed shell having a rear opening, and a movable shell rotatably connected to the fixed shell and configured to cover the rear opening, the movable shell is swingable away from the rear opening, a first tightening strap is connected to a side of the fixed shell, a locking device is connected to another side of the fixed shell, the first tightening strap is releasably locked by the locking device, and as the first tightening strap is released from the locking device, the movable shell can swing away relative to the fixed shell.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
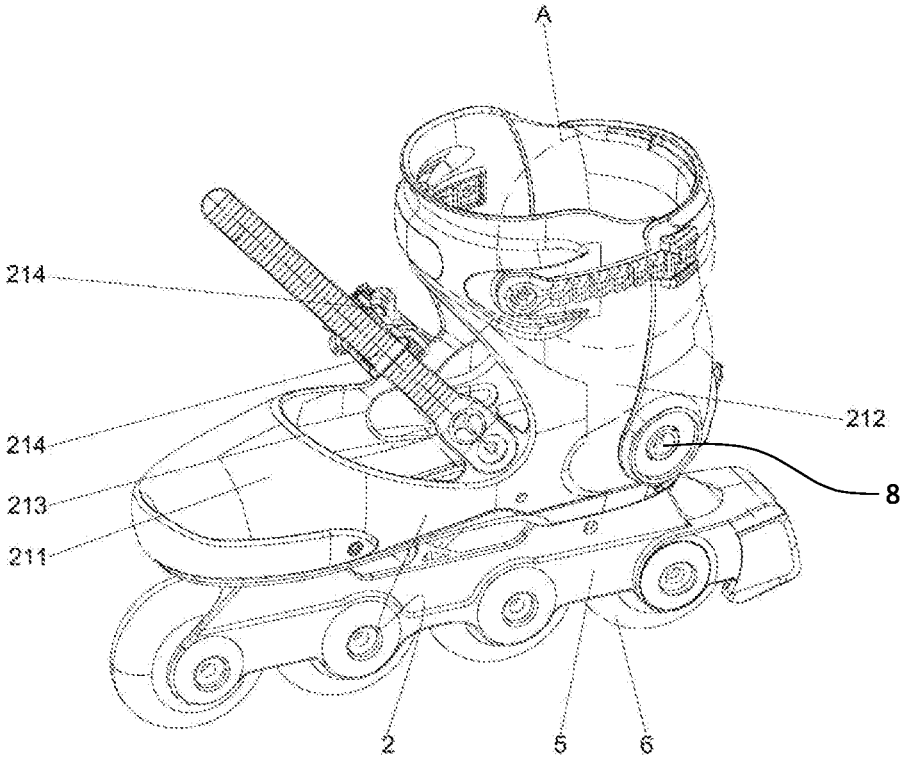
FIG. 1 is a first stereogram of an exemplary embodiment of the present invention.

Please refer to FIGS. 1 to 5 for an exemplary embodiment of the present invention. An easy-wearing skate of the present invention includes a boot 2 having a chamber 1 open upward. The boot 2 further includes a fixed shell 21 having a rear opening 217, and a movable shell 22 rotatably connected to the fixed shell 21 and configured to cover the rear opening 217. The movable shell 22 is swingable away from the rear opening 217. A first tightening strap 3 is connected to a side of the fixed shell 21, and a locking device 4 is connected to another side of the fixed shell 21, and the first tightening strap 3 is releasably locked by the locking device 4. Preferably, the first tightening strap 3 is rotatably connected to the fixed shell 21 by a pivot 7. As the first tightening strap 3 is released from the locking device 4, the movable shell 22 can swing away relative to the fixed shell 21. Through the cooperation of the first tightening strap 3 and the locking device 4, the movable shell 22 can be positioned or released so that the skate is easy to wear. When the movable shell 22 is in the tightened state, it can block the foot and prevent the foot from departing from the skate. When the movable shell 22 is in the release state, the movable shell 22 can being swung backwards to expand the opening of the chamber 1 to make it easier for the user's foot to come into the chamber 1.

Figure 2:
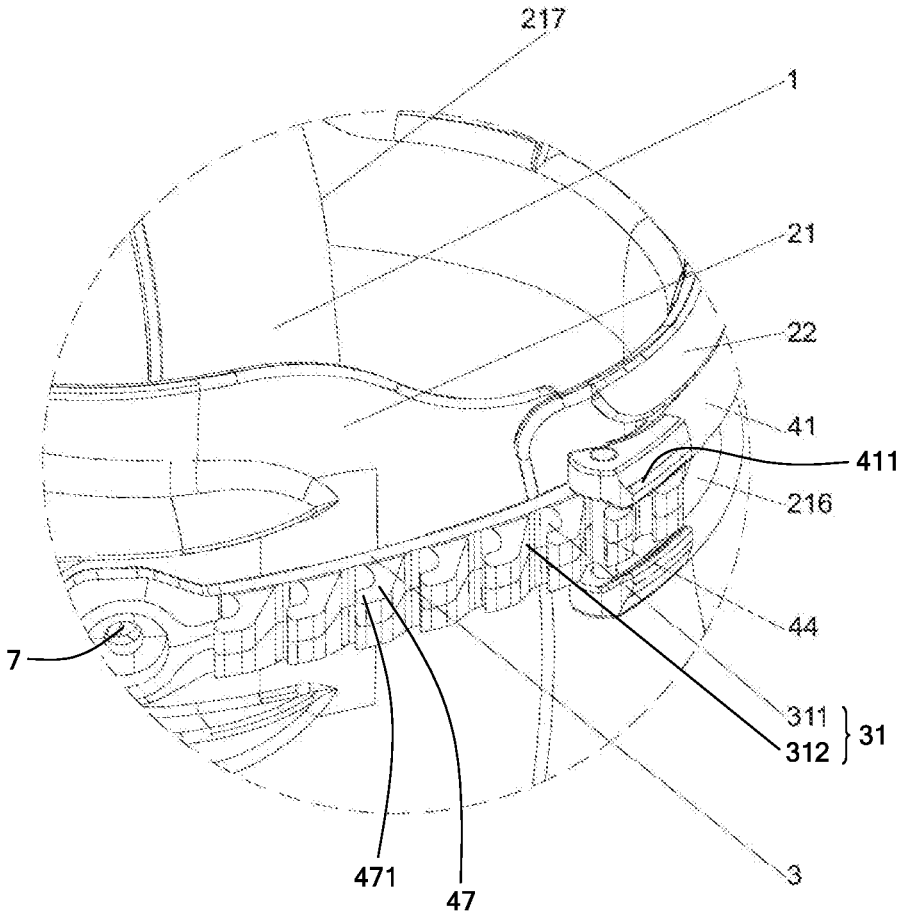
FIG. 2 is a partial enlargement of a region A of FIG. 1.
Figure 3:
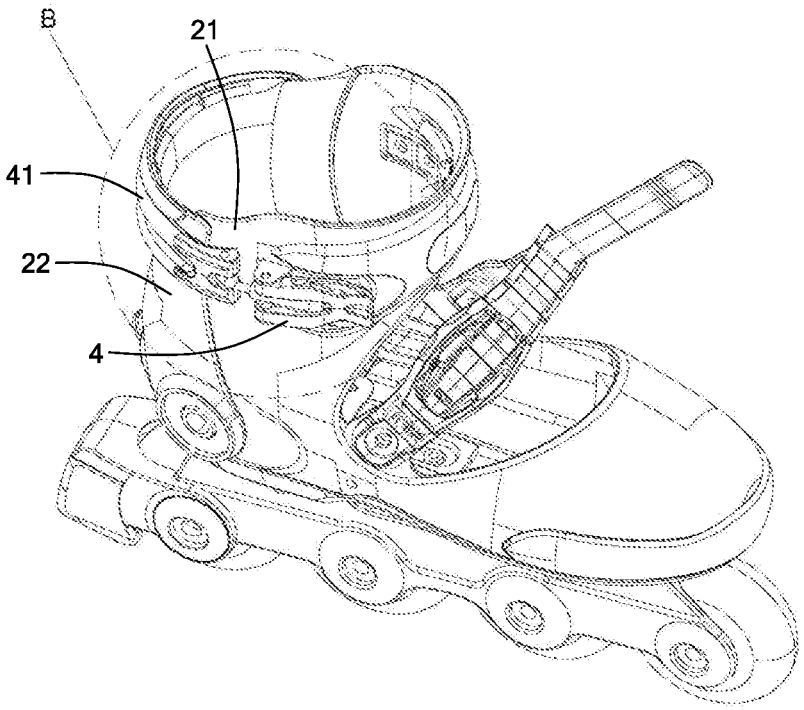
FIG. 3 is a second stereogram of an exemplary embodiment of the present invention.
Figure 4:
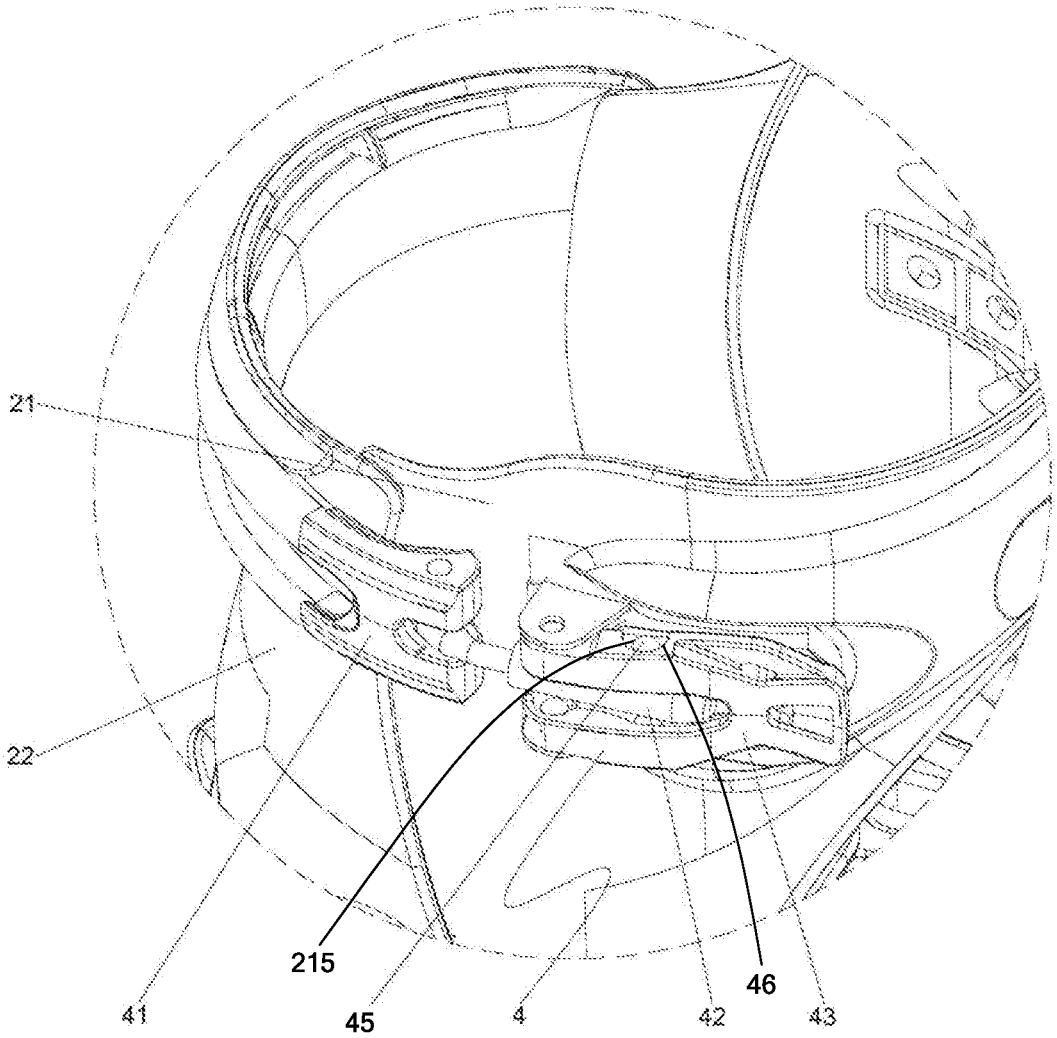
FIG. 4 is a partial enlargement of a region B of FIG. 3.
Figure 5:
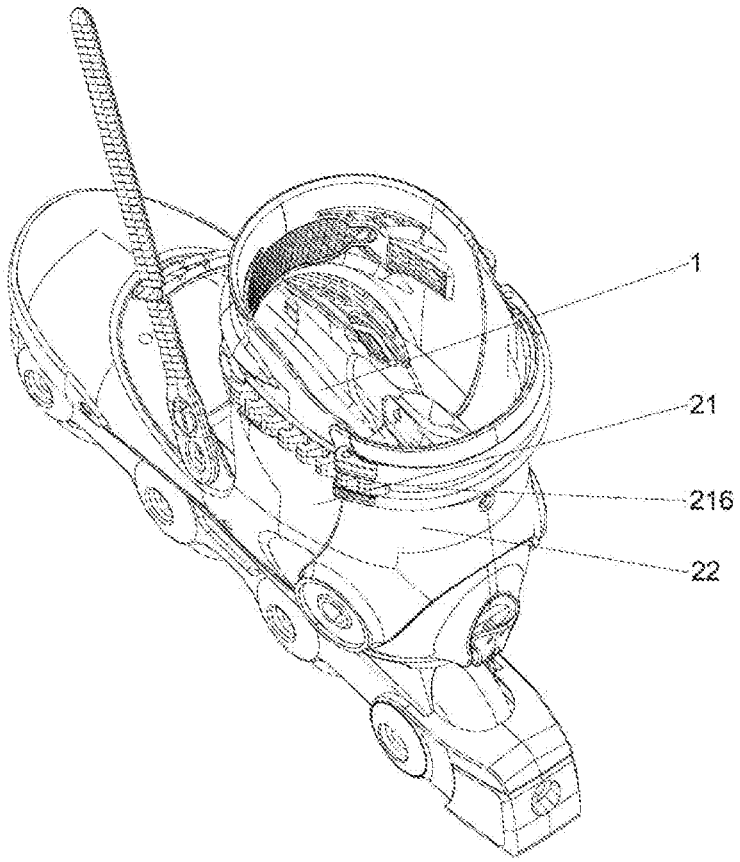
FIG. 5 is a third stereogram of an exemplary embodiment of the present invention.

As shown in FIGS. 2, 4 and 5, the locking device 4 includes a belt 41, a rod 42 and a lever buckle 43, the belt 41 extends at a rear side of the movable shell 22, a first end of the belt 41 and the first tightening strap 3 are releasably locked with each other, a second end of the belt 41 is rotatably connected to an end of the rod 42, the lever buckle 43 is rotatably connected to the fixed shell 21 and frontwardly and rearwardly swingable relative to the fixed shell 21, a second end of the rod 42 is rotatably connected to a middle portion of the lever buckle 43, the belt 41 and the first tightening strap 3 are locked with each other and tensioned as a free end of the lever buckle 43 swings to approach the fixed shell 21 so that the rod 42 pulls the belt 41, and the belt 41 and the first tightening strap 3 are released from each other as the free end of the lever buckle 43 swings to be away from the fixed shell 21. Through the cooperation of the locking device 4 and the first tightening strap 3, the first tightening strap 3 can be tensioned or loosened.

As shown in FIG. 4, perforations 215 are provided in the middle of the second end of the rod 42 and the lever buckle 43, respectively, and a shaft 45 is installed in the perforations 215 to connect the rod 42 to the lever buckle 43. Additionally, the lever buckle 43 includes a groove, the second end of the rod 42 is received in the groove, and the shaft 45 is transversely disposed through the groove. Preferably, the lever buckle 43 further includes a notch 46, and the end of the shaft 45 is received in the notch 46.

The locking device 4 is configured to adjust the tightness of the first tightening strap 3 so that the skate has good applicability for different users with better comfort.

As shown in FIG. 2, the first end of the belt 41 includes a pin 44, the first tightening strap 3 includes a plurality of engaging slots 31 arranged intervals along a longitudinal direction of the first tightening strap 3, and the pin 44 is removably engaged and restricted in one of the plurality of engaging slots 31. The pin 44 is selectively to be engaged and restricted in appropriate one of the plurality of engaging slots 31 according to the condition of their feet.

Specifically, each of the plurality of engaging slots 31 extends in a direction inclined to a thickness direction of the first tightening strap 3. When the first tightening strap 3 and the locking device 4 are locked, the pulling force from the lever buckle 43 on the pin 44 is in the opposite direction to the opening direction of the engaging slot 31, so that the pin 44 can be tightly locked in the engaging slot 31 and is not easy to disengaged from the engaging slot 31.

Specifically, each of the plurality of engaging slots 31 includes an inner section 311 and an outer section 312 in communication with each other, the outer section 312 is open in the thickness direction of the first tightening strap 3, and in the longitudinal direction of the first tightening strap 3 the outer section 312 is narrower than the inner section 311. As such, the pin 44 can be reliably engaged in the engaging slot 31. Preferably, the pin 44 has a diametric dimension larger than a dimension of the outer section 312 in the longitudinal direction of the first tightening strap 3.

Preferably, the first tightening strap 3 further includes a plurality of hooked projections 47 each located between neighboring two of the plurality of engaging slots 31 and slanting frontwards. Each of the plurality of hooked projections 47 includes a distal section 471 extending frontwards and parallel to the longitudinal direction of the first tightening strap 3. Specifically, the first end of the belt 41 further includes two side walls 411, and the pin 44 is connected to and between the two side walls 411. When the pin 44 is engaged in one of the plurality of engaging slots 31, at least two of the plurality of hooked projections 47 are received between the two side walls 411, and in the thickness direction of the first tightening strap 3 each of the two side walls 411 is higher than the at least two of the plurality of hooked projections 47.

To obtain easier and stable cooperation of the first tightening strap 3 and the belt 41, the belt 41 further includes an elongated groove 216 extending in a middle portion thereof, and the elongated groove 216 is configured to receive an end portion of the first tightening strap 3 as the pin 44 is engaged in the engaging slot 31 so that the first tightening strap 3 can be stably guided along the elongated groove 216.

As shown in FIG. 1, the fixed shell 21 includes a vamp portion 211 and an ankle portion 212 connected to each other, and the rear opening 217 is located in back of the ankle portion 212.

The vamp portion 211 and the ankle portion 212 form a front opening 213 therebetween, two second tightening straps 214 are connected to the fixed shell 21 and located at two sides of the front opening 213, respectively, and the two second tightening straps 214 are adjustably connected to each other. Preferably, two fixation members are disposed on the fixed shell 21 and located at two sides of the front opening 213, respectively, and the two second tightening straps 214 are connected to the two fixation members, respectively. The two second tightening straps 214 can sufficiently and stable tighten and hold the foot in the boot 2.

Each of two sides of a lower end of the movable shell 22 is rotatably connected to the fixed shell 21 by a hinge 8, which provides a smooth and strong connection between the fixed shell 21 and the movable shell 22.

The easy-wearing skate further includes a frame 5 connected to a bottom of the boot 2 and rollers 6 mounted on the frame 5.

The first tightening strap 3, the belt 41 and the two second tightening straps 214 may be made of plastic material, which is easy to manufacture.

In use, when the first tightening strap 3 and the locking device 4 are in the release state, it allows the user's foot to put into the chamber 1 easily; the pin 44 on the belt 41 is engaged in one of the plurality of engaging slots 3; the lever buckle 43 is swung frontward to drive the rod 42 to pull the belt 41 and the first tightening strap 3 to move toward the lever buckle 43, the pin 44 is firmly engaged within the engaging slot 31, and the belt 41 and the first tightening strap 3 are therefore in the tightened state and the movable shell 22 covers the rear opening 217; and the two second tightening straps 214 are connected to each other and tensioned.

To release the belt 41, it only needs to swing the lever buckle 43 backward such that the rod 42 drives the belt 41 to move toward the first tightening strap 3 to loosen the first tightening strap 3, and the movable shell 22 is swingable relative to the fixed shell 21, so that the user's foot can be removed out from the boot 2 easily. Preferably, it is to loosen the two second tightening straps 214 before the skate is taken off, which makes it easier to take off the skate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An easy-wearing skate including a boot having a chamber open upward, wherein the boot further includes a fixed shell having a rear opening, and a movable shell rotatably connected to the fixed shell and configured to cover the rear opening, the movable shell is swingable away from the rear opening, a first tightening strap is connected to a side of the fixed shell, a locking device is connected to another side of the fixed shell, the first tightening strap is releasably locked by the locking device, and as the first tightening strap is released from the locking device, the movable shell can swing away relative to the fixed shell;

wherein the fixed shell includes a vamp portion and an ankle portion connected to each other, and the rear opening is located in back of the ankle portion.

2. The easy-wearing skate of claim 1, wherein the locking device includes a belt, a rod and a lever buckle, the belt extends at a rear side of the movable shell, a first end of the belt and the first tightening strap are releasably locked with each other, a second end of the belt is rotatably connected to an end of the rod, the lever buckle is rotatably connected to the fixed shell and frontwardly and rearwardly swingable relative to the fixed shell, a second end of the rod is rotatably connected to a middle portion of the lever buckle, the belt and the first tightening strap are locked with each other and tensioned as a free end of the lever buckle swings to approach the fixed shell so that the rod pulls the belt, and the belt and the first tightening strap are released from each other as the free end of the lever buckle swings to be away from the fixed shell.

3. The easy-wearing skate of claim 2, wherein the first tightening strap is rotatably connected to the fixed shell.

4. The easy-wearing skate of claim 3, wherein the first end of the belt includes a pin, the first tightening strap includes a plurality of engaging slots arranged intervals along a longitudinal direction of the first tightening strap, and the pin is removably engaged and restricted in one of the plurality of engaging slots.

5. The easy-wearing skate of claim 4, wherein each of the plurality of engaging slots extends in a direction inclined to a thickness direction of the first tightening strap.

6. The easy-wearing skate of claim 5, wherein each of the plurality of engaging slots includes an inner section and an outer section in communication with each other, the outer section is open in the thickness direction of the first tightening strap, and in the longitudinal direction of the first tightening strap the outer section is narrower than the inner section.

7. The easy-wearing skate of claim 6, wherein the pin has a diametric dimension larger than a dimension of the outer section in the longitudinal direction of the first tightening strap.

8. The easy-wearing skate of claim 5, wherein the first tightening strap further includes a plurality of hooked projections each located between neighboring two of the plurality of engaging slots and slanting frontwards.

9. The easy-wearing skate of claim 8, wherein each of the plurality of hooked projections includes a distal section extending frontwards and parallel to the longitudinal direction of the first tightening strap.

10. The easy-wearing skate of claim 9, wherein the first end of the belt further includes two side walls, and the pin is connected to and between the two side walls; and when the pin is engaged in one of the plurality of engaging slots, at least two of the plurality of hooked projections are received between the two side walls, and in the thickness direction of the first tightening strap each of the two side walls is higher than the at least two of the plurality of hooked projections.

11. The easy-wearing skate of claim 2, wherein the rod and the lever buckle are connected to each other by a shaft, the lever buckle further includes a notch, and the end of the shaft is received in the notch.

12. The easy-wearing skate of claim 1, wherein the vamp portion and the ankle portion form a front opening therebetween, two second tightening straps are connected to the fixed shell and located at two sides of the front opening, respectively, and the two second tightening straps are adjustably connected to each other.

13. The easy-wearing skate of claim 1, wherein each of two sides of a lower end of the movable shell is rotatably connected to the fixed shell by a hinge.

14. The easy-wearing skate of claim 1, further including a frame connected to a bottom of the boot and rollers mounted on the frame.

* * * * *